US005850794A

United States Patent [19]

Raschbichler et al.

[11] Patent Number: 5,850,794

[45] Date of Patent: Dec. 22, 1998

[54] METHOD FOR ARRANGING AND ARRANGEMENT OF FUNCTIONAL COMPONENTS AT THE TRACK SUPPORT STRUCTURE OF RAIL-BOUND VEHICLES

[75] Inventors: Hans Georg Raschbichler; Luitpold Miller, both of Ottobrunn; Gert Schwindt, Gröbenzell; Reinhard Rampelmann, Starnberg; Christian Rosin, Reichling, all of Germany

[73] Assignee: Thyssen Industrie AG, Essen, Germany

[21] Appl. No.: 809,349

[22] PCT Filed: Sep. 22, 1995

[86] PCT No.: PCT/EP95/03755

§ 371 Date: Mar. 21, 1997

§ 102(e) Date: Mar. 21, 1997

[87] PCT Pub. No.: WO96/09438

PCT Pub. Date: Mar. 28, 1996

[30] Foreign Application Priority Data

Sep. 23, 1994 [DE] Germany ..... 44 34 121.0

[51] Int. Cl.[6] ..... E01B 26/00

[52] U.S. Cl. ..... 104/281; 104/124; 104/111

[58] Field of Search ..... 104/89, 111, 118, 104/124, 125, 281, 282, 283, 284, 126; 248/317, 903

[56] References Cited

U.S. PATENT DOCUMENTS

| | | | |
|---|---|---|---|
| 2,577,789 | 11/1951 | McCarn | 104/111 |
| 2,824,913 | 2/1958 | Taylor | 105/111 |
| 5,140,208 | 8/1992 | Tozoni | 104/281 |
| 5,291,834 | 3/1994 | Quaas | 104/281 |

FOREIGN PATENT DOCUMENTS

| | | | |
|---|---|---|---|
| 0151283 | 8/1985 | European Pat. Off. . | |
| 151283 | 8/1985 | European Pat. Off. | 104/281 |
| 0410153 | 1/1991 | European Pat. Off. . | |
| 0585763 | 3/1994 | European Pat. Off. . | |
| 2425027 | 12/1975 | Germany | 104/281 |
| 2715717 | 9/1978 | Germany . | |
| 3702421 | 4/1988 | Germany . | |
| 3837774 | 5/1990 | Germany . | |
| 4115936 | 11/1992 | Germany | 104/281 |
| 4219200 | 12/1993 | Germany . | |

OTHER PUBLICATIONS

Zeitschrift für Eisenbahnwesen und Verkehrstechnik Glasers Annalen, 105 (1981) No. 7/8, p. 210.

*Primary Examiner*—Mark Tuan Le

*Attorney, Agent, or Firm*—Robert W. Becker & Associates

[57] ABSTRACT

In a method for arranging functional components at a support structure of a track of rail-bound vehicles, a first functional component is furnished with first positioning elements. Projecting arms of the support structure are provided with throughbores. The first positioning elements are inserted into the throughbores such that the first positioning elements penetrate the projecting arms. A second functional component is placed onto the first positioning elements. The arrangement of functional components at a support structure of a track for rail-bound vehicles includes a first functional component having connected thereto first positioning elements. The first functional component has a functional surface. The first positioning elements have abutment surfaces positioned at a defined distance to the functional surface. A second functional component is placed onto the abutment surfaces for exactly positioning the second functional component relative to the first functional component. Connecting locations are provided at the track for connecting thereto the first functional component by introducing the first positioning elements.

10 Claims, 3 Drawing Sheets

METHOD FOR ARRANGING AND ARRANGEMENT OF FUNCTIONAL COMPONENTS AT THE TRACK SUPPORT STRUCTURE OF RAIL-BOUND VEHICLES

BACKGROUND OF THE INVENTION

The invention relates to a method for arranging and an arrangement for functional components at the support structure of tracks for rail-bound vehicles, especially magnetic levitation trains.

Tracks for rail-bound transport systems, especially magnetic levitation trains, comprise a plurality of functional components such as furnishings for supporting, guiding and moving the vehicles and devices for information transmission and energy exchange between vehicle and track. These components must be positioned relative to one another and to the comparatively fast moving vehicle in a defined position.

From the prior art various possibilities are known in order to fulfill the requirements for a location-exact positioning of furnishings and functional components at the supports of the track for rail-bound transport systems.

For example, according to German Offenlegungsschrift 27 15 717 adjustable screw connections can be used for positioning and fastening the track furnishings which may compensate manufacturing tolerances in regard to the position of the fastening means connected to the track.

Furthermore, from the Zeitschrift für Eisenbahnwesen und Verkehrstechnik Glasers Annalen, 105 (1981) No. 7/8, page 210, it can be taken that an exact positioning of furnishings can be achieved by casting fastening bolts in a defined position at the support structure of the track.

The aforementioned solutions have a considerable disadvantage in common, especially in regard to the complicated adjustment of fastening, respectively, connecting elements.

According to the teaching of European application 0 151 283 B1, in a working step subsequent to the manufacture of the support structure, the connecting bodies fastened to the support structure are provided with size-exact throughbores and/or blind bores. This results in a greatly simplified mounting of the furnishings of the support structure.

The solution represented in German application 42 19 200 A1 has the advantage of a comparatively simple mounting of the functional components on a box-like and inherently stable module which is subsequently mounted to the longitudinal edges of the track support. The considerable mass of the number of functional components combined in the module and its longitudinal extension, however, are contrary to a location-exact positioning of such a module.

It is an object of the invention to provide a further simplification for the position-exact arrangement of functional components at the support structure of tracks for rail-bound vehicles.

SUMMARY OF THE INVENTION

The method for arranging functional components at a support structure of a track of rail-bound vehicles according to the present invention includes the steps of:

- furnishing a first functional component with first positioning elements;
- providing projecting arms of the support structure with throughbores;
- inserting the first positioning elements into the throughbores such that the first positioning elements penetrate the projecting arms;
- resting on the first positioning elements a second functional component.

The method may further comprise the step of position-precisely arranging the first functional component at the support structure.

The method may also comprise the steps of positioning the second functional component at the first functional component in a predetermined relative position to one another and materially connecting the second functional component to the first positioning elements in the predetermined relative position.

The step of furnishing includes selecting positioning elements in the form of securing elements for anchoring the first functional component in the support structure. The method further comprises the step of rigidly connecting the positioning elements to the support structure.

The inventive arrangement of functional components at a support structure of a track for rail-bound vehicles, wherein at least two functional components are in a defined position relative to one another and relative to the track, is characterized by:

- a first functional component having connected thereto first positioning elements;
- the first functional component having a functional surface;
- the first positioning elements having abutment surfaces positioned at a defined distance to the functional surface;
- a second functional component placed onto the abutment surfaces for exactly positioning the second functional component relative to the first functional component;
- connecting locations provided at the track for connecting thereto the first functional component by introducing the first positioning elements.

The track preferably has projecting arms with throughbores and the first positioning elements are received in the throughbores.

The first positioning elements are expediently securing elements for securing the first functional component at a support structure of the track.

The positioning elements include anchor connections having connecting stays with end faces as an abutment surface for respectively arranging the functional component thereat.

The first functional component is a stator pack.

The arrangement may further comprise grooved transverse beams and screw connections, wherein the anchor connections include anchor bolts, wherein the stator packs are positive-lockingly and frictionally connected via the grooved transverse beams and the screw connections to the anchor bolts of the anchor connections, wherein a positive-locking action of the grooved transverse beams is effective only after a frictional connection of the screw connections fails.

Inventively, this object is solved with the method of the aforementioned kind in that a first functional component is provided with positioning elements, that the positioning elements are inserted into throughbores provided within the area of the projecting arms of the track support so as to penetrate them, and that subsequently a second functional component is brought into abutment at the positioning elements.

Furthermore, the solution to the aforementioned object in an arrangement of the aforementioned kind consists of providing at the first functional component positioning elements which have contact surfaces, located at a defined distance to a functional surface of the first functional component, for exactly positioning a second functional component relative to the first functional component and providing at the track connecting locations for the first functional component into which the positioning elements of the first functional component are to be inserted.

The invention has the advantage that based on the location-exact fixation of a first functional component, which is provided with positioning elements for providing exact positioning of further functional components thereat, further functional components can be placed onto the support structure of the track in the required position relative to the support structure, without having to determine the position of these functional components relative to the support structure. The required position results inevitably when the further functional component is brought into abutment at the positioning elements of the first functional component. Thus, the alignment expenditure for all of the functional components to be connected to the track can be reduced considerably.

Furthermore, there is a possibility to exactly determine the precision of the position of the functional components relative to the track via the number of positioning elements per length unit of the track. This also allows for preventing discontinuities at transitions from one portion of the functional component to neighboring portions of the same functional component.

Furthermore, it is also within the scope of the invention to provide further functional components with positioning elements, whereby the positioning elements of different functional components may be brought into relative abutment at one another.

In an expedient embodiment of the method, the first functional component is arranged in an exact position relative to the support structure of the track.

The second functional component can then be materially connected to the positioning elements of the first functional component in a predetermined position of the functional components relative to one another in order to introduce forces acting onto the second functional component via the positioning elements of the first functional components into the track.

It is furthermore advantageous to embody the positioning elements connected to the first functional component as securing elements for the purpose of anchoring within the support structure of the track and to provide a rigid connection of these positioning elements with the support structure.

In a preferred embodiment of the arrangement, the projecting arms of the track are provided with throughbores in which the positioning elements of the first functional component are received.

Furthermore, positioning elements of the first functional component can be used as fastening elements of the first functional component at the support structure of the track.

In a preferred embodiment, the positioning elements of the first functional component are comprised of anchor connections and connecting stays with end faces as abutment surfaces for the location-exact precise arrangement of the second functional components so that the positioning elements, in addition to positioning, also have a fastening function.

The first functional component may be a stator pack that is expediently positive-lockingly and frictionally connected via grooved transverse beams and screw connection to the anchor bolts of the anchor connections, whereby the positive-locking connection provided by the grooved transverse beam will become effective only after failure of the frictional connection provided by screw connection.

The invention will be explained in more detail in the following with the aid of the drawings in which a preferred embodiment of the invention is illustrated.

BRIEF DESCRIPTION OF THE DRAWINGS

It is shown in.

DESCRIPTION OF PREFERRED EMBODIMENTS

Figure 1:
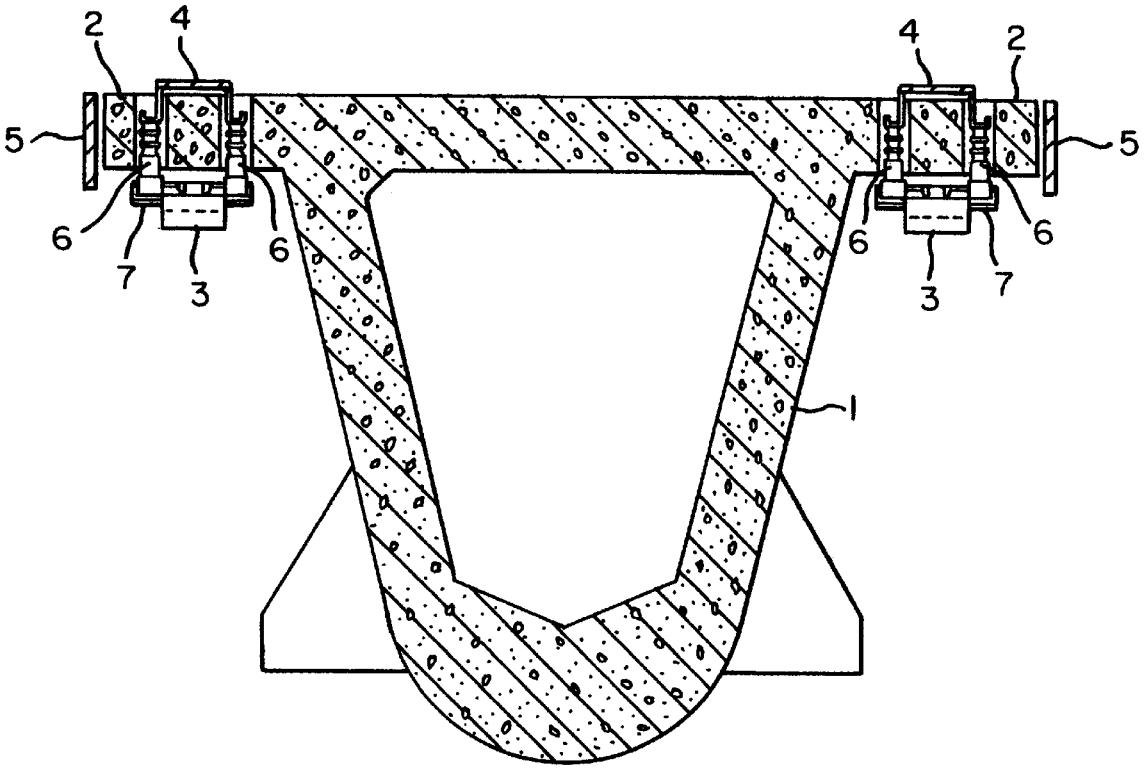
FIG. 1 a track support of concrete, furnished with stator packs, glide rails, and lateral guide rails as functional components.

The track support structure 1 represented in cross-section in FIG. 1 is provided at the two oppositely arranged projecting arms 2 with the stator packs 3, glide rails 4, and lateral guide rails 5, respectively, needed for the operation of the track-bound vehicle.

Figure 2:
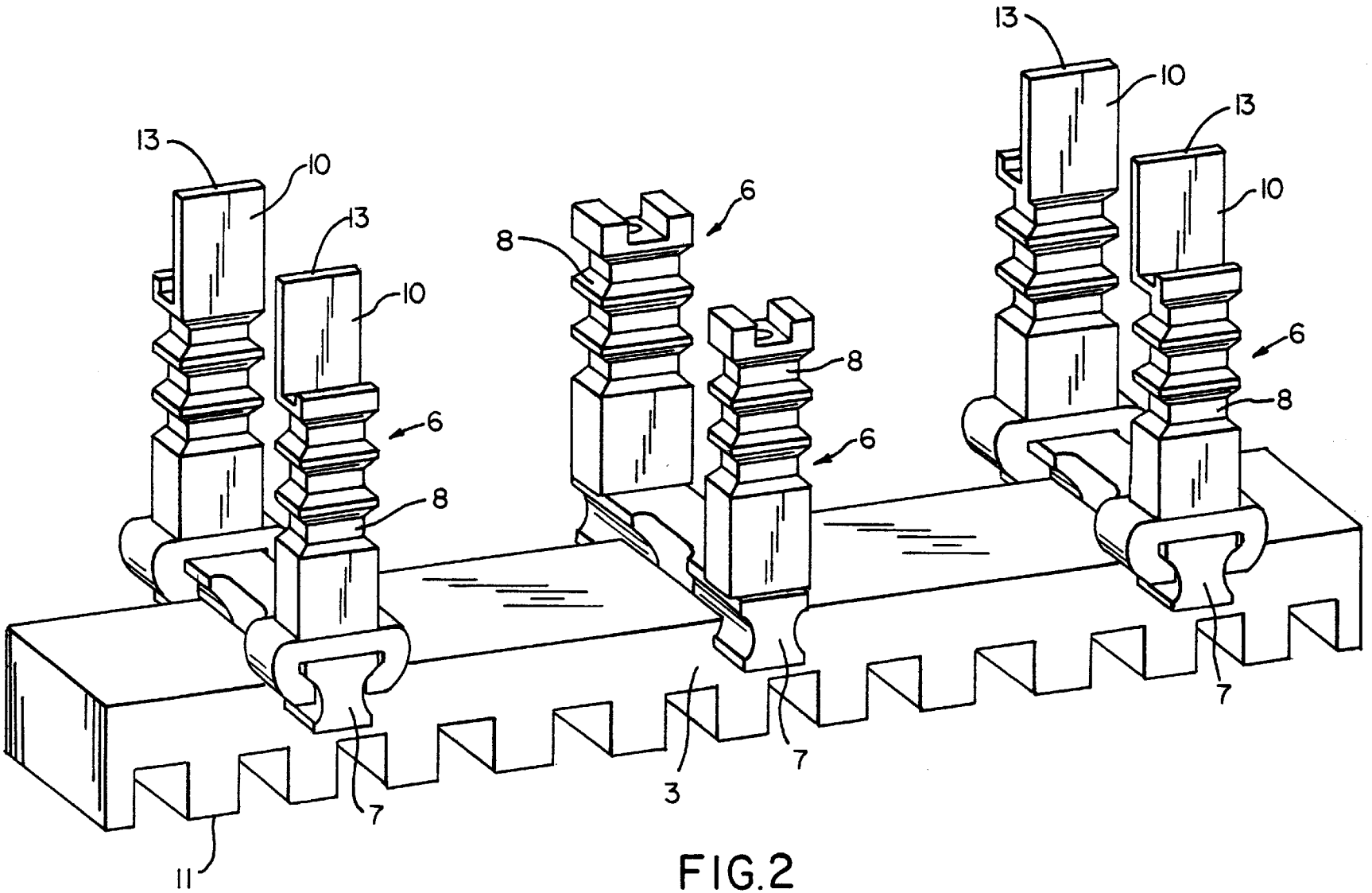
FIG. 2 a stator pack with anchors whereby a number thereof has connecting stays for the arrangement of glide rails as further functional components.

For fastening the stator packs 3, as can be seen in FIG. 2, two different anchor connections 6 are being used. The anchor connections 6 have in common that they are realized by screw connections 9 acting by frictional connection on the grooved transverse beams 7 and the anchor bolts 8. They differ however at the end piece of the anchor connection 6 facing away from the stator pack 3. Thus, a number of the anchor connection 6 is extended by a connecting stay 10 so that a connection with the glide rail 4 can be realized. The amount of extension is determined by the required distance between the bottom edge 11 of the stator pack and the glide rail 4.

Figure 3:
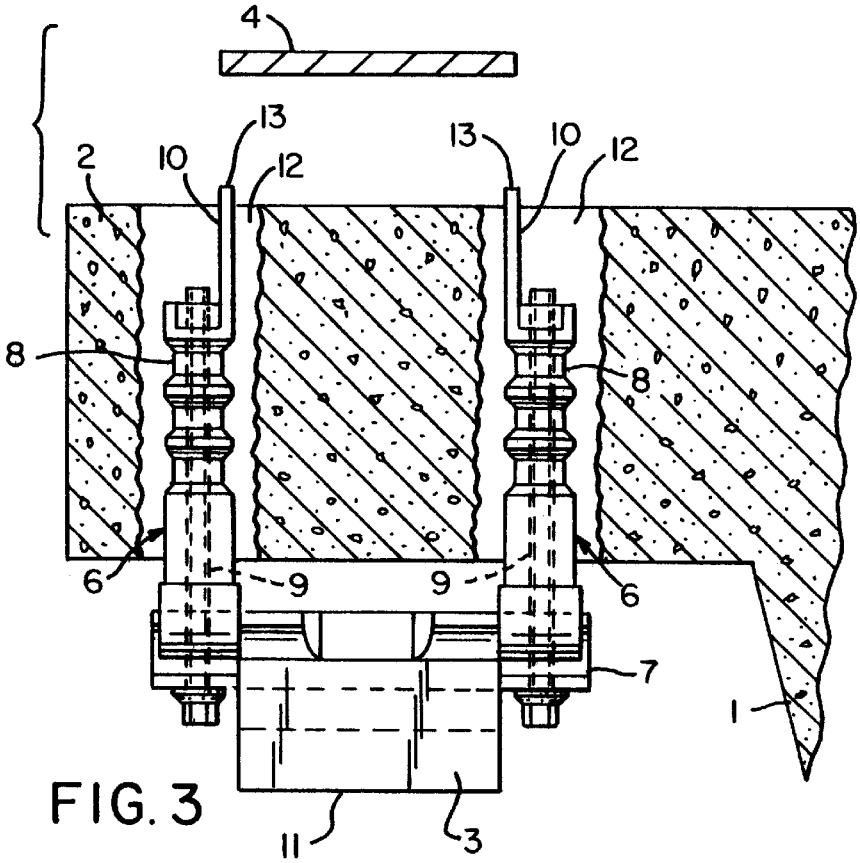
FIG. 3 a part-sectional representation transverse to the track support in the area of the anchor connections provided with connecting stays.
Figure 4:
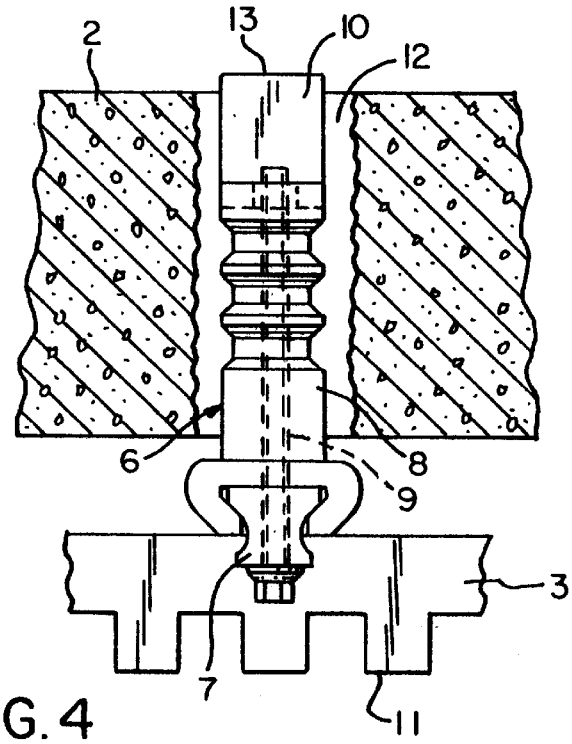
FIG. 4 a cross-sectional view according to FIG. 3 but in the longitudinal direction of the track support.

For fastening the stator pack 3 and the glide rail 4 at the track support 1, the stator packs 3 provided with the anchor connections 6 are positioned in the required position relative to the track support 1 whereby the anchors 6 are inserted into throughbores 12 of the track support 1 (FIGS. 3, 4). The stator packs 3 are fixed in this position until the grouting compound poured into the throughbores 12 has hardened.

Subsequently, the glide rails 4, which are preferably comprised of steel, are placed onto the end faces 13 of the connecting stays 10 and anchored within the track support 1. A defined distance between the stator pack bottom edge 11 and the glide rail 4 at the track support 1 is ensured in that the anchor connections 6 of a first functional component, in this case the stator pack 3, has been inventively modified to a positioning element for a further functional component, i.e., the glide rail 4.

There is further the possibility to connect the glide rail 4 with the connecting stays 10 of the anchor connections 6 to the stator pack 3 in a rigid manner. In such a case, the stator pack 3 is maintained in its precise position when for diverse anchor connections 6 the rigid connection to the track support 1 will break when, for example, the grouting compound will break away from the walls of the throughbores 12.

Based on the principle idea of the invention, further ideas in regard to modifying the anchor connections of functional components into positioning elements for further functional components, for example, to provide the glide rails 4 with positioning elements for positioning the lateral guide rails 5 relative to the glide rails 4 and to use therefor modified anchor connections of the guide rails 4.

In principle, it is also possible to arrange a plurality of functional components, positioned relative to one another, in a defined position at the track support 1.

The present invention is, of course, in no way restricted to the specific disclosure of the specification and drawings, but also encompasses any modifications within the scope of the appended claims.

What we claim is:

1. A method for arranging functional components at a support structure of a track of rail-bound vehicles, said method comprising the steps of:

furnishing a first functional component with first positioning elements;

providing projecting arms of the support structure with throughbores;

after said step of providing, inserting the first positioning elements into the throughbores such that the first positioning elements penetrate the projecting arms;

resting on the first positioning elements a second functional component; and wherein the first and second functional components are selected from the group consisting of stator packs, glide rails, guide rails, and devices for information transmission and for energy exchange between the vehicle and the track.

2. A method according to claim 1, further comprising the step of position-precisely arranging the first functional component at the support structure.

3. A method according to claim 1, further comprising the steps of:

positioning the second functional component in a predetermined position relative to the first functional component; and materially connecting the second functional component to the first positioning elements in the predetermined position.

4. A method according to claim 1, wherein said step of furnishing includes selecting the positioning elements in the form of securing elements for anchoring the first functional component in the support structure, the method further comprising the step of rigidly connecting the positioning elements to the support structure.

5. An arrangement of functional components at a support structure of a track for rail-bound vehicles; said arrangement comprising:

a first functional component having connected thereto first positioning elements;

said first functional component having a functional surface;

said first positioning elements having abutment surfaces positioned at a defined distance to said functional surface;

a second functional component placed onto said abutment surfaces for exactly positioning said second functional component relative to said first functional component;

preformed connecting locations provided at the track for connecting thereto said first functional component, wherein said first positioning elements are;

positioned in said connecting locations, said first positioning elements being formed with a configuration for allowing insertion of said first positioning elements into said preformed connecting locations;

wherein at least said first and second functional components are in a defined position relative to one another and relative to the track;

wherein said first and second functional components are selected from the group consisting of stator packs, glide rails, guide rails, and devices for information transmission and for energy exchange between the vehicle and the track.

6. An arrangement according to claim 5, wherein the track has projecting arms with throughbores and wherein said first positioning elements are received in said throughbores.

7. An arrangement according to claim 5, wherein said first positioning elements are securing elements for securing said first functional component at the support structure of the track.

8. An arrangement according to claim 5, wherein said first positioning elements include anchor connections having connecting stays with end faces as an abutment surface for respectively arranging said second functional component thereat.

9. An arrangement according to claim 8, wherein said first functional component is a stator pack.

10. An arrangement of functional components at a support structure of a track for rail-bound vehicles, said arrangement comprising:

a first functional component having connected thereto first positioning elements;

said first functional component having a functional surface;

said first positioning elements having abutment surfaces positioned at a defined distance to said functional surface;

a second functional component placed onto said abutment surfaces for exactly positioning said second functional component relative to said first functional component;

connecting locations provided at the track for connecting thereto said first functional component, wherein said first positioning elements are introduced into said connecting locations;

wherein at least said first and said second functional components are in a defined position relative to one another and relative to the track;

wherein said first positioning elements include anchor connections having connecting stays with end faces as an abutment surface for respectively arranging said second functional component thereat;

further comprising grooved transverse beams and screw connections, wherein said anchor connections include anchor bolts, wherein said first functional components are positive-lockingly and frictionally connected via said grooved transverse beams and said screw connections to said anchor bolts of said anchor connections, wherein a positive-locking action of said grooved transverse beams is effective only after a frictional connection of said screw connections fails.

* * * * *